US008374517B2

(12) United States Patent
Nagatsuka

(10) Patent No.: US 8,374,517 B2
(45) Date of Patent: Feb. 12, 2013

(54) IMAGE FORMING DEVICE WITH AN INTERMITTENT DRIVING UNIT AND COMPUTER-READABLE RECORDING MEDIUM EXECUTED BY THE IMAGE FORMING DEVICE

(75) Inventor: Shingo Nagatsuka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 490 days.

(21) Appl. No.: 12/722,688

(22) Filed: Mar. 12, 2010

(65) Prior Publication Data

US 2010/0239276 A1 Sep. 23, 2010

(30) Foreign Application Priority Data

Mar. 17, 2009 (JP) ..... 2009-065297
Mar. 8, 2010 (JP) ..... 2010-050385

(51) Int. Cl.
*G03G 15/00* (2006.01)

(52) U.S. Cl. ..... 399/43; 399/44

(58) Field of Classification Search ..... 399/37, 399/43

See application file for complete search history.

(56) References Cited

U.S. PATENT DOCUMENTS 4,935,777 A * 6/1990 Noguchi et al. ..... 399/128
6,993,263 B2 * 1/2006 Arimura ..... 399/50
8,145,080 B2 * 3/2012 Murata et al. ..... 399/43
2004/0037577 A1 2/2004 Shimura et al.
2004/0101322 A1 * 5/2004 Tsukida et al. ..... 399/27
2006/0029442 A1 * 2/2006 Ide ..... 399/327
2006/0204258 A1 * 9/2006 Yamane ..... 399/44
2007/0041740 A1 * 2/2007 Sasai ..... 399/44
2008/0298826 A1 * 12/2008 Yonekubo ..... 399/44
2009/0116859 A1 * 5/2009 Mohri ..... 399/43
2009/0297182 A1 * 12/2009 Kinukawa et al. ..... 399/43

FOREIGN PATENT DOCUMENTS

JP 2004-109980 4/2004
JP 2004-264647 9/2004
JP 2007-065581 3/2007

* cited by examiner

*Primary Examiner* — Walter L Lindsay, Jr.
*Assistant Examiner* — David Bolduc
(74) *Attorney, Agent, or Firm* — IPUSA, PLLC

(57) ABSTRACT

An image forming device includes an image support object, a charging unit, an exposure unit, and a developing unit. The image forming device further includes a monitoring unit that sequentially updates a count value to a new count value according to a rotation state and a stop state of the image support object, and an intermittent driving unit that intermittently rotates the image support object according to the new count value generated by the monitoring unit after an image formation operation to form the toner image on the image support object surface is completed.

18 Claims, 12 Drawing Sheets

FIG.6

| ROTATIONAL SPEED OF PHOTOCONDUCTOR | COUNT-UP VALUE |
|---|---|
| STANDARD SPEED | 3 |
| HALF SPEED | 2 |
| LOW SPEED | 1 |

IMAGE FORMING DEVICE WITH AN INTERMITTENT DRIVING UNIT AND COMPUTER-READABLE RECORDING MEDIUM EXECUTED BY THE IMAGE FORMING DEVICE

BACKGROUND OF THE INVENTION

1. Field of the Invention

This invention relates to an image forming device and a computer-readable recording medium.

2. Description of the Related Art

An image forming device of electrophoto-graphic type according to the related art is known. The image forming device of this type includes a charging part, an exposure part, a developing part, a transfer part, and a cleaning part, which are disposed around the periphery of a cylindrical photoconductor drum. During operation of the image forming device, a toner image is formed on the surface of the photoconductor drum when the photoconductor drum is rotated, and the toner image is transferred from the photoconductor drum to a printing medium, such as a copy sheet.

In the image forming device of this type, a toner charging process is performed with the developing part for frictional charging of a toner in the developing part. The amount of charge of the toner generated by performing the toner charging process varies depending on the temperature and the humidity of the atmosphere in which the toner exists.

There is almost no influence on the amount of charge of the toner by the atmosphere during a normal image formation operation (or a printing operation). However, if the image forming device restarts a printing operation after an end of a standby state being continued over a certain period of time, a significant influence on the amount of charge of the toner by the atmosphere may appear during an image formation operation immediately after the restart due to the humidity change.

Normally, a developing part for supplying a toner to a photoconductor drum is arranged to store the toner in a closed space in order to prevent scattering of the toner. FIG. 1 is a diagram for explaining a movement of toner in a vicinity of a developing device. As illustrated in FIG. 1, a toner 6, a developing roller 3, and a supplying roller 4 are accommodated in a toner container part 2*a* of a developing device 2. An opening of the developing device 2 is substantially closed by a developing blade 5, the developing roller 3, and a toner return part 2*b* that constitutes a part of a side wall of the developing device 2.

When the image forming device is in an image formation operation and in a standby state, the gap between the developing blade 5 and the developing roller 3 and the gap between the developing roller 3 and the toner return part 2*b* are in a closed state with the toner 6.

During the image formation operation, a part of a toner 6*b* that is delivered from the developing device 2 by the developing roller 3 adheres to a surface 1*a* of a photoconductor drum 1 to form a toner image (an image formation toner 6*c*) on the surface 1*a* of the photoconductor drum 1, and the remainder of the toner 6*b* is returned through the toner return part 2*b* to the inside of the developing device 2 (a return toner 6*d*).

However, if the image forming device is set in a standby state of image formation, the toner 6*b* outside the developing device 2 remains adhering to the developing roller 3 and is not returned back to the inside of the developing device 2 which is formed as the closed space. As long as the standby state continues, the toner 6*b* outside the developing device 2 is easily influenced by a change of the environmental temperature or humidity outside the developing device 2.

Generally, during an image formation operation of the image forming device, the portion in the vicinity of the photoconductor drum is subjected to a high-temperature, low-humidity condition (the relative humidity is lowered by a temperature rise). During a standby state of image formation, the high-temperature, low-humidity condition of the portion is gradually changed to be equal to the external environmental temperature and humidity. The toner 6*a* inside the developing device 2 is not easily influenced by a change of the external environment because it is stored in the closed space of the developing device 2. In contrast, the toner 6*b* outside the developing device 2 is easily influenced by a change of the environmental temperature and humidity during the standby state, which results in a deterioration of the toner charging performance.

The formation of a toner image on the photoconductor drum 1 during image formation operation is performed using the action of an electric charge of the toner, and a deterioration of the toner charging performance directly affects the image formation state on the photoconductor drum, namely, affecting the image quality. Subsequently, at a next time of image formation, a toner image is formed on the photoconductor drum 1 by using the toner 6*b* outside the developing device (which has been affected by the surrounding environment during the standby state) and the toner 6*a* inside the developing device (which is not affected in the closed space). In such a case, belt-like image density irregularities may occur in the toner image due to the difference in the toner charging performance between the toner 6*a* and the toner 6*b*.

Conventionally, several approaches to eliminating the problem of image density irregularities due to the change of the toner charging performance have been proposed.

For example, Japanese Laid-Open Patent Publication No. 2004-109980 discloses an image forming device which is arranged to perform a rotating operation to rotate the developing roller each time the image formation stopping time reaches a given period, in order to optimize the image density controlling factors.

Japanese Laid-Open Patent Publication No. 2007-065581 discloses a developing device in which an environmental sensor is disposed in a developing part of each color. This developing device is arranged to optimize the toner charging state in accordance with changes of the humidity of the developing part detected by the sensor.

Japanese Laid-Open Patent Publication No. 2004-264647 discloses an image forming device in which a sensor is disposed in the vicinity of a photoconductor drum to detect a change of the environmental humidity during a standby state of the image forming device. When the humidity change detected by the sensor is large, the photoconductor drum is rotated by a given amount of rotation in order to prevent the image density irregularities which easily take place immediately when the standby state is switched to an active state of image formation operation.

In the image forming device of Japanese Laid-Open Patent Publication No. 2004-109980, the rotating operation to rotate the developing roller is performed at intervals of a fixed time during a standby state, and the influence by the outside environment on the toner adhering to the developing roller can be eliminated. However, in this image forming device, the power consumption during the standby state is increased by the rotating operation of the developing roller performed during the standby state.

In the image forming device of Japanese Laid-Open Patent Publication No. 2007-065581, the change of the environmental state of the toner inside the developing device is detected, but the change of the environmental state of the toner adhering to the portion exposed to the outside of the developing device cannot be detected. It is difficult for this image forming device to eliminate the problem of image density irregularities which easily take place at a time of restarting of an image formation operation immediately after an end of a standby state.

In the image forming device of Japanese Laid-Open Patent Publication No. 2004-264647, the sensor has to be disposed in the vicinity of the photoconductor drum to detect a change of the humidity in the vicinity of the photoconductor drum, which increases the manufacture cost and may put the restrictions on the layout of the image forming device.

SUMMARY OF THE INVENTION

In one aspect of the invention, the present disclosure provides an image forming device which is able to prevent, without using an output signal of a sensor disposed in a vicinity of the photoconductor drum, the image density irregularities which easily take place at a start of an image formation operation.

In an embodiment of the invention which solves or reduces one or more of the above-mentioned problems, the present disclosure provides an image forming device including: an image support object; a charging unit that electrically charges a surface of the image support object which is rotated; an exposure unit that exposes the charged surface of the image support object to a light beam so that an electrostatic latent image is formed on the image support object surface; a developing unit that causes an electrically charged toner to adhere to the electrostatic latent image on the image support object surface so that a toner image is formed on the image support object surface; a monitoring unit configured to sequentially update a count value to a new count value according to a rotation state and a stop state of the image support object; and an intermittent driving unit configured to intermittently rotate the image support object according to the new count value generated by the monitoring unit after an image formation operation to form the toner image on the image support object surface is completed.

Other objects, features and advantages of the invention will become more apparent from the following detailed description when read in conjunction with the accompanying drawings.

BRIEF DESCRIPTION OF THE DRAWINGS

FIG. 6 is a diagram illustrating the setting of a count-up value with respect to a specific rotational speed of the photoconductor drum.

DETAILED DESCRIPTION OF THE PREFERRED EMBODIMENTS

A description will be given of embodiments of the invention with reference to the accompanying drawings.

Figure 2:
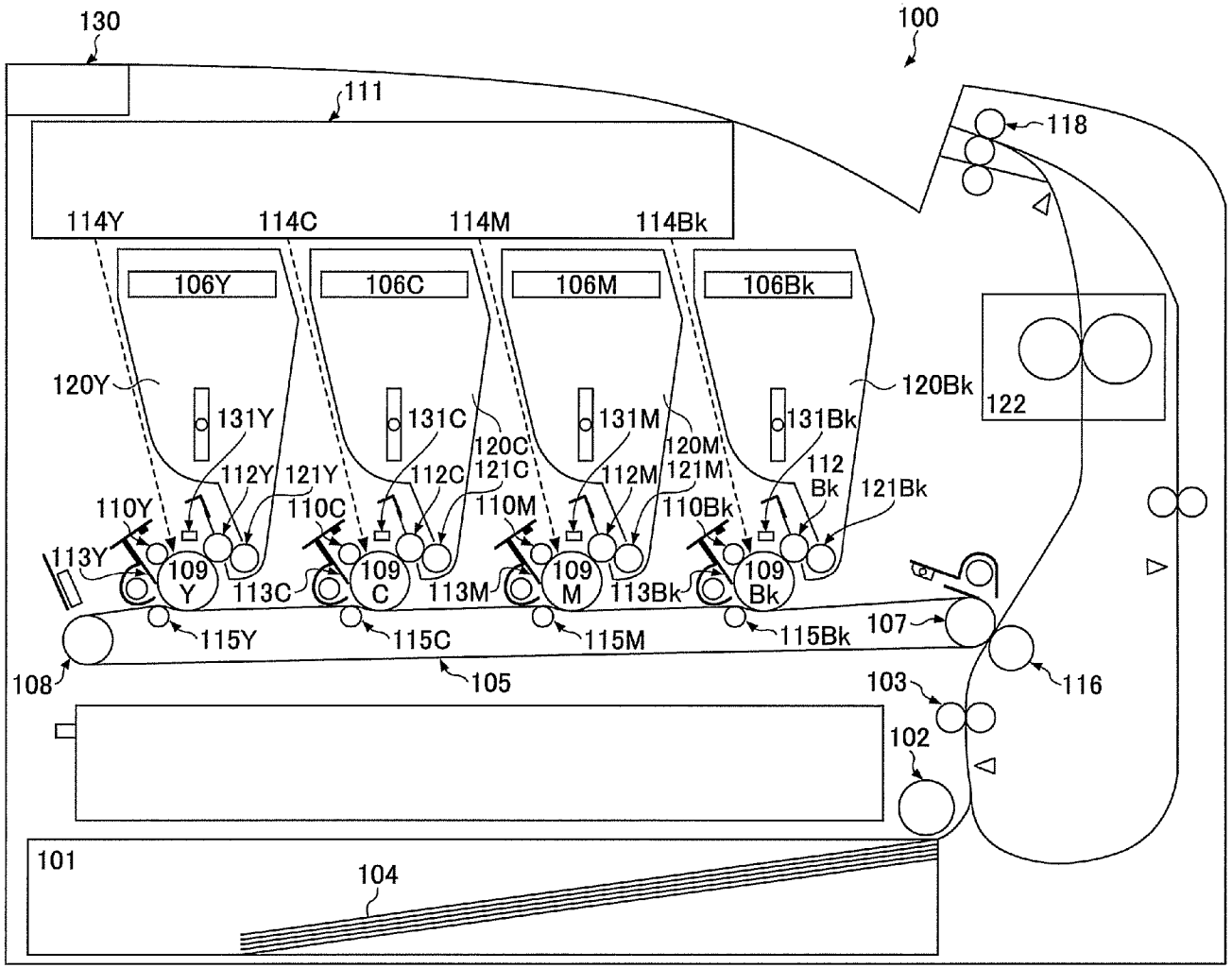
FIG. 2 is a diagram illustrating the composition of an image forming device according to the invention.

FIG. 2 is a diagram illustrating the composition of an image forming device according to the invention. This image forming device 100 is constructed to include four AIO cartridges (106Bk, 106M, 106C, 106Y) of four colors which are arranged side by side along an intermediate transfer belt 105. This image forming device 100 is called a tandem type image forming device.

The intermediate transfer belt 105 is rotated counter clockwise. The AIO cartridges 106Bk, 106M, 106C and 106Y (electrophotographic process parts) are arrayed in this order from the upstream side in the rotational direction of the intermediate transfer belt 105. These AIO cartridges 106Bk, 106M, 106C and 106Y have the same composition and only the colors of the respective toners contained in the AIO cartridges differ from each other. The AIO cartridge 106Bk supplies a toner of black to form a toner image of black, the AIO cartridge 106M supplies a toner of magenta to form an image of magenta, the AIO cartridge 106C supplies a toner of cyan to form a toner image of cyan, and the AIO cartridge 106Y supplies a toner of yellow to form a toner image of yellow, respectively.

Operation of each of the component parts of the image forming device 100 is controlled by a control unit 130. Specifically, the control unit 130 controls operation of each of the AIO cartridge 106, the intermediate transfer belt 105 and a fixing unit 122. The control unit 130 collects detection information from a temperature humidity sensor 131 (environment detection unit), performs a warm-up operation of the image forming device 100 before image formation operation, and performs the monitoring and control of the respective component parts in a standby state after an end of an image formation operation.

Figure 1:
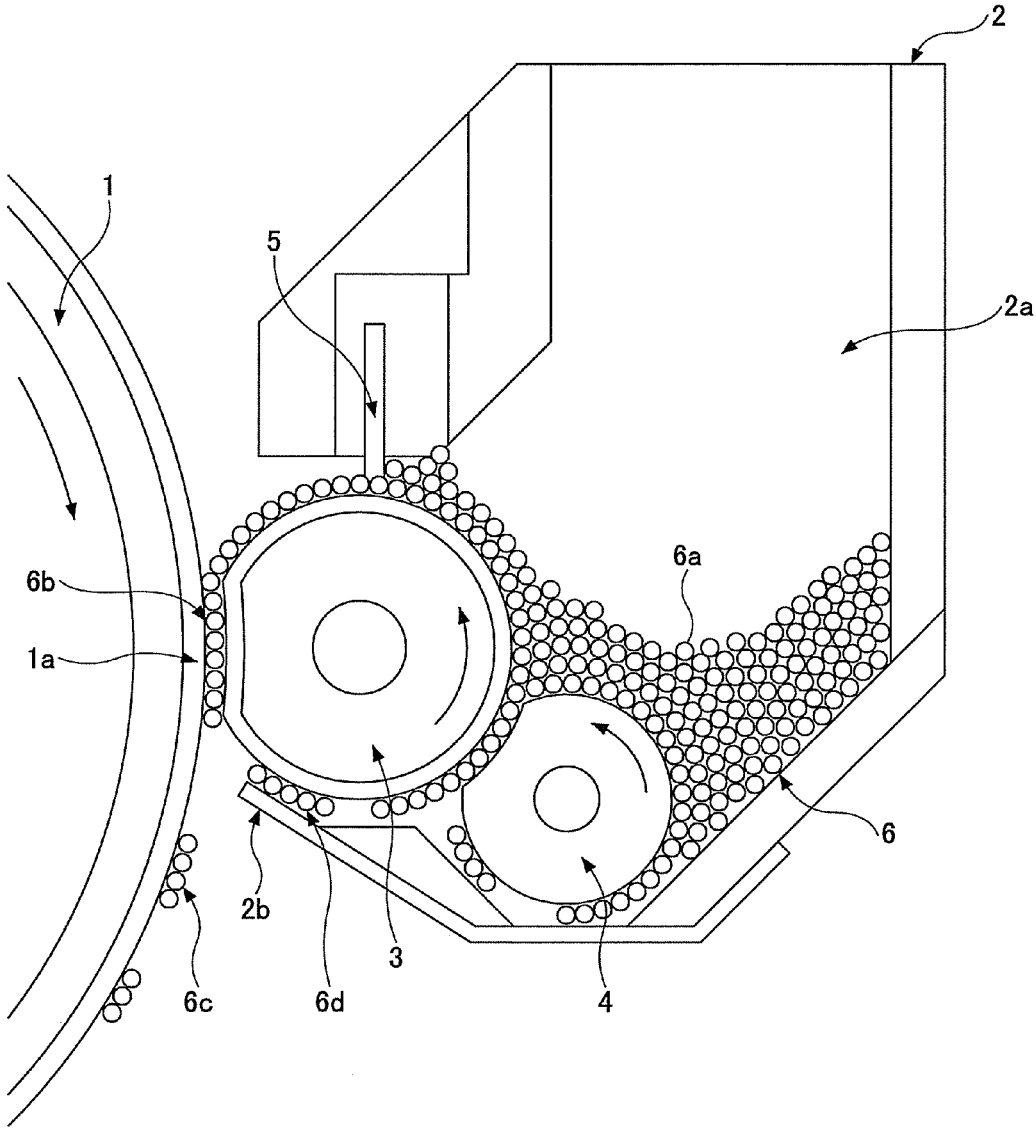
FIG. 1 is a diagram for explaining a movement of toner in a vicinity of a developing device.

The relationship between the photoconductor drum and the developing device in the image forming device 100 of this embodiment is the same as illustrated in FIG. 1. In the image forming device of FIG. 2, a photoconductor drum 109 and a developing roller 112 of a developing device 106 are in contact with each other to form a nip part therebetween, and the toner adheres to the developing roller 112 at the nip part by the electrostatic attraction. The rotating operation of the photoconductor drum 109 and the rotating operation of the developing roller 112 are mutually synchronized, and also the rotation stop operations thereof are mutually synchronized. Namely, if the photoconductor drum 109 is rotated, the developing roller 112 is rotated simultaneously, and if the rotation of the photoconductor drum 109 is stopped, the rotation of the developing roller 112 is stopped simultaneously.

In the following, a description will be given of the AIO cartridge 106Bk only. The AIO cartridges 106M, 106C, and 106Y have the same composition as that of the AIO cartridge 106Bk, and a duplicate description thereof will be omitted.

In the composition of FIG. 2, the intermediate transfer belt 105 is an endless belt which is wound on each of a secondary transfer driving roller 107 and a transfer belt tension roller 108. The secondary transfer driving roller 107 is rotated by a drive motor (not illustrated). The drive motor, the secondary transfer driving roller 107, and the transfer belt tension roller 108 constitute a driving unit which rotates and moves the intermediate transfer belt 105.

In the composition of FIG. 2, the AIO cartridge 106Bk (image formation part) includes a toner container part 120Bk (which contains a toner as a printing agent), a developing roller 112Bk (which is a developing unit disposed in an opening of the toner container part 120Bk), a photoconductor drum 109Bk (which is a rotatable image support object contacting the developing roller 112Bk to form a nip part therebetween), a charging part 110Bk (which is a charging unit disposed on the periphery of the photoconductor drum 109Bk), and a cleaner blade 113Bk (which is a cleaning unit disposed to clean out the toner adhering to the photoconductor drum surface). In addition, a supplying roller 121Bk (which is a toner supplying unit to supply the toner to the developing roller 112Bk) is disposed inside the toner container part 120Bk.

An exposure part 111 (which is an exposure unit) is disposed above the AIO cartridge 106Bk. The exposure part 111 is arranged to emit laser beams 114Bk, 114M, 114C, 114Y from the laser light sources (not illustrated) to the surfaces of the photoconductor drums 109Bk, 109M, 109C, 109Y, respectively, which laser beams correspond to respective colors of the toner images to be formed by the AIO cartridges 106Bk, 106M, 106C, and 106Y.

In the image forming device 100 of this embodiment, the AIO cartridge 106 and the exposure part 111 constitute an image formation unit.

During image formation operation, the surface of the photoconductor drum 109Bk is uniformly charged by the charging part 110Bk in the dark, and the charged surface of the photoconductor drum 109Bk is exposed to the laser beam 114Bk (corresponding to a black image) from the exposure part 111, so that an electrostatic latent image is formed thereon. The developing roller 112Bk produces a visible image from the electrostatic latent image by using the black toner, and the toner image of black is formed on the photoconductor drum 109Bk.

The toner image of black is transferred to the intermediate transfer belt 105 at a position (primary transfer position) where the photoconductor drum 109Bk and the intermediate transfer belt 105 are in contact, by the action of the primary transfer roller 115Bk. Thereby, the toner image of black is formed on the intermediate transfer belt 105.

After the transfer of the toner image to the intermediate transfer belt 105 is completed, the non-used toner remaining on the surface of the photoconductor drum 109Bk is wiped away by the cleaner blade 113Bk to clean the photoconductor drum surface, and the photoconductor drum 109Bk is ready for use in a next image formation operation. If the next image formation operation is not requested, the image forming device 100 is set in a standby state.

The toner image of black transferred to the intermediate transfer belt 105 by the AIO cartridge 106Bk is delivered to the following AIO cartridge 106M by the secondary transfer driving roller 107. In the AIO cartridge 106M, a toner image of magenta is formed on the photoconductor drum 109M through the image formation operation which is the same as in the AIO cartridge 106Bk. The toner image of magenta from the photoconductor drum 109M is transferred to the intermediate transfer belt 105 and superimposed on the toner image of black previously formed on the intermediate transfer belt 105.

Subsequently, the intermediate transfer belt 105 is delivered to the position facing the AIO cartridge 106C, and further to the position facing the AIO cartridge 106Y. Through the image formation operation which is the same as in the AIO cartridge 106M, the toner image of cyan formed on the photoconductor drum 109C, and the toner image of yellow formed on the photoconductor drum 109Y are sequentially transferred to the intermediate transfer belt 105 and superimposed on the toner images previously formed thereon. In this way, a full color toner image is formed on the intermediate transfer belt 105.

In a case in which a monochrome printing of black is performed, the image formation operation is performed as follows. In this case, the primary transfer roller 115M, the primary transfer roller 115C, and the primary transfer roller 115Y are evacuated to positions that are separated from the photoconductor drum 109M, the photoconductor drum 109C, and the photoconductor drum 109Y, respectively. Only the photoconductor drum 109Bk is placed in the normal position in contact with the intermediate transfer belt 105, and the image formation operation of black is carried out with the photoconductor drum 109Bk and the intermediate transfer belt 105.

In the composition of FIG. 2, a sheet feeding unit is disposed under the intermediate transfer belt 105. The sheet feeding unit includes a sheet feed tray 101, a supplying roller 102, and a registration roller 103. A secondary transfer roller 116 is disposed at a position that faces the secondary transfer driving roller 107. The intermediate transfer belt 105 is interposed between the secondary transfer driving roller 107 and the secondary transfer roller 116, and these rollers 107 and 116 form a secondary transfer nip part. Furthermore, in the composition of FIG. 2, a fixing unit 122 and a delivery roller 118 are disposed above the secondary transfer nip part.

The sheet feed tray 101 contains plural copy sheets 104 as printing media which are stacked therein, and the supplying roller 102 is made in contact with the top copy sheet 104 in the sheet feed tray 102. The supplying roller 102 is rotated by a driving unit (which is not illustrated) to deliver the copy sheet 104, and, when the leading edge of the copy sheet 104 is in contact with the registration roller 103, the rotation of the supplying roller 102 is temporarily stopped. Thereafter, at an appropriate timing, the copy sheet 104 is delivered to the secondary transfer nip part where a transfer bias voltage is supplied. The toner image formed on the intermediate transfer belt 105 is transferred to the copy sheet 104 at the secondary transfer nip part.

To the intermediate transfer belt 105 after the copy sheet 104 passes through the secondary transfer nip part, the remaining toner which was not transferred to the copy sheet 104 still adheres. Such toner is cleaned by the transfer belt cleaner.

The copy sheet 104 having passed through the secondary transfer nip part is subjected to heat and pressure when the copy sheet 104 passes through the gap between the rollers of the fixing unit 122, so that the toner image transferred to the sheet surface is fixed to the copy sheet 104. Then, the copy sheet 104 is ejected to the outside of the image forming device 100 by the delivery roller 118.

Next, the composition of a control unit 130 in the image forming device 100 of FIG. 2 will be described with reference to FIG. 3.

Figure 3:
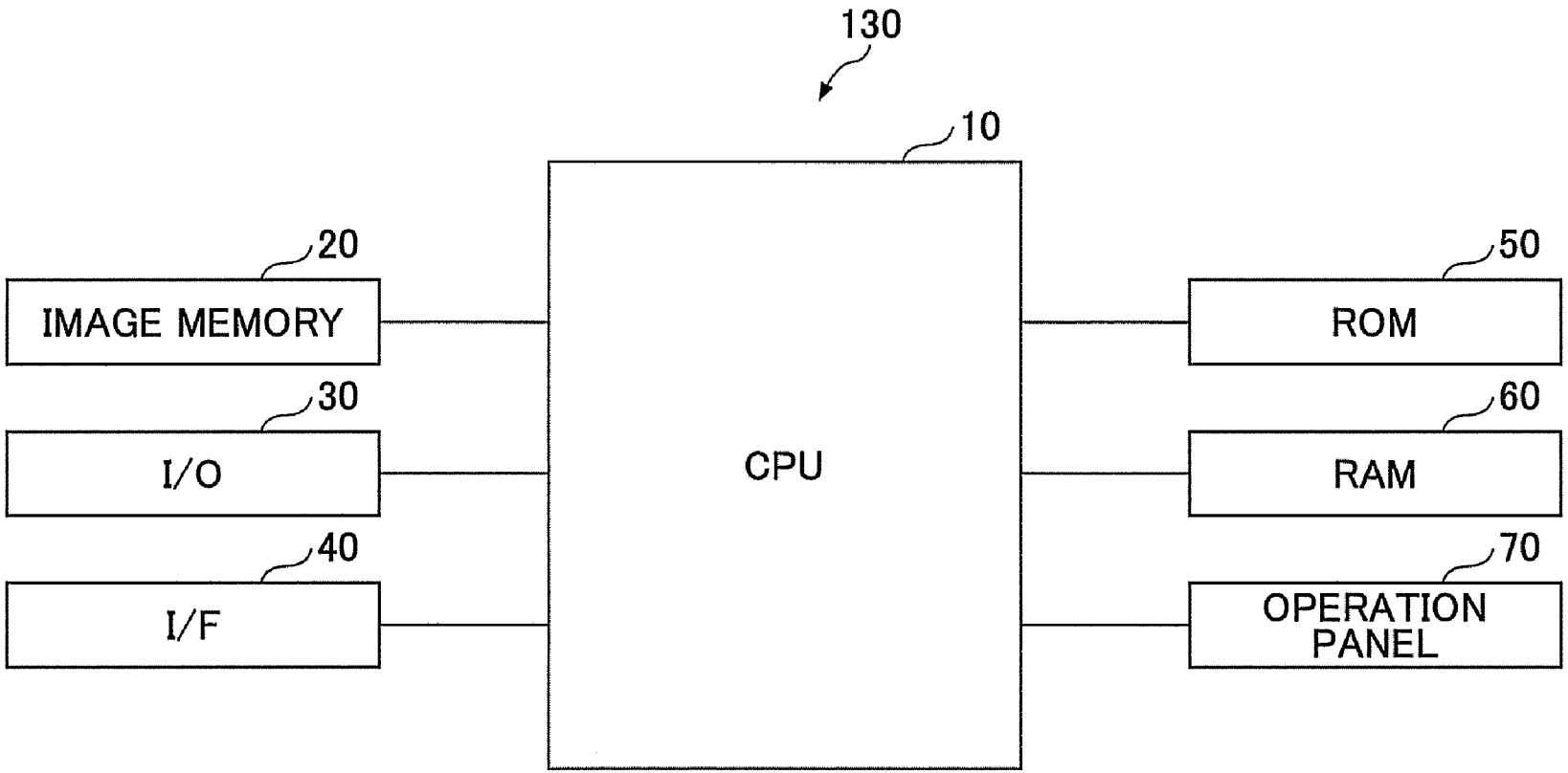
FIG. 3 is a block diagram illustrating the composition of a control unit of the image forming device of FIG. 2.

As illustrated in FIG. 3, the control unit 130 of the image forming device 100 includes a CPU 10, an image memory 20, an I/O (input/output part) 30, an I/F (interface part) 40, a ROM 50, a RAM 60, and an operation panel 70. The CPU 10 controls operation of each of the component parts of the image forming device 100 in accordance with execution of a control program stored in the ROM 50 by the CPU 10. The CPU 10 synthetically controls the whole image formation operation of the image forming device 100 and controls the supplementary operation to allow the image formation operation to be performed smoothly.

For example, the CPU 10 controls the rotating operation of the photoconductor drum 109Bk (which is a main task in the image formation operation), and controls the exposure operation of the exposure part 111Bk, the toner supplying operation of the developing roller 112Bk to the image support object, and the driving operation of the intermediate transfer belt 105, which are synchronized with the rotating operation of the photoconductor. In accordance with the execution of the control program, the CPU 10 functions as a monitoring unit which monitors a rotation state of the photoconductor when the image forming device is in an image-formation-operation state or a standby state, and functions as a drive control unit which controls the rotation and driving of the motor to rotate the photoconductor if needed. Further, in accordance with the execution of the control program, the CPU 10 functions as an environmental change determining unit which determines an environmental change based on detection information received from a sensor which measures a temperature and a humidity in the vicinity of the photoconductor.

The image memory 20 temporarily stores image data contained in printing data. The I/O 30 controls the inputting and outputting of the electronic parts, such as the image formation part and the sensor. The I/F 40 receives printing data and user inquiries and responses from a personal computer or a sever connected to the image forming device via a cable or others. The ROM 50 stores the control program for controlling the whole image forming device. The RAM 60 stores temporarily various kinds of information, including the information related to the image formation operation of the image forming device, and the environment information, such as temperature or humidity information. The operation panel 70 is a user interface unit which enables the user to view the state of the image forming device, and to change the operation of the image forming device.

With reference to FIGS. 4-8, an image forming device of a first embodiment of the invention, and an image formation operation performed by the control unit of the image forming device of the first embodiment will be described.

Figure 4:
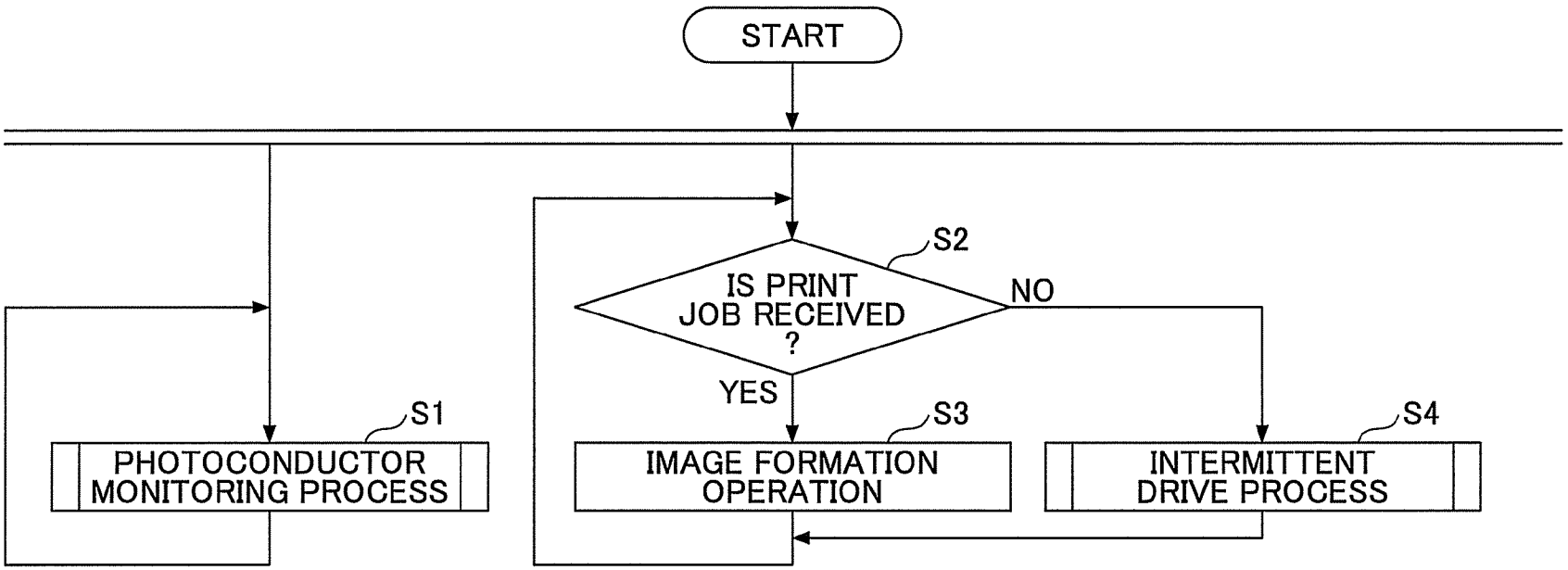
FIG. 4 is a flowchart for explaining an image formation operation performed by a control unit of an image forming device of a first embodiment of the invention.
Figure 5A:
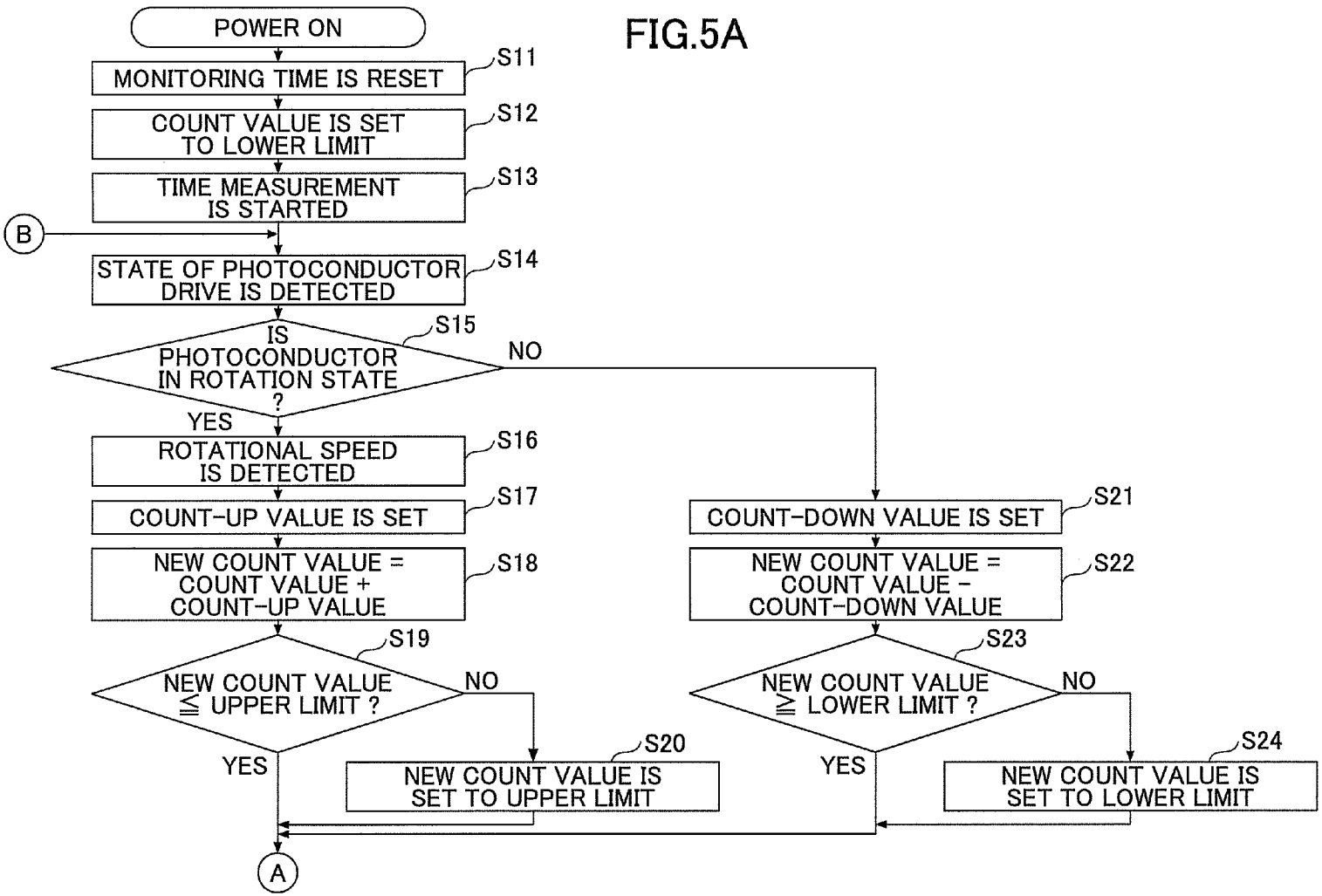
FIG. 5A and FIG. 5B are parts of a flowchart for explaining a photoconductor monitoring process.
Figure 5B:
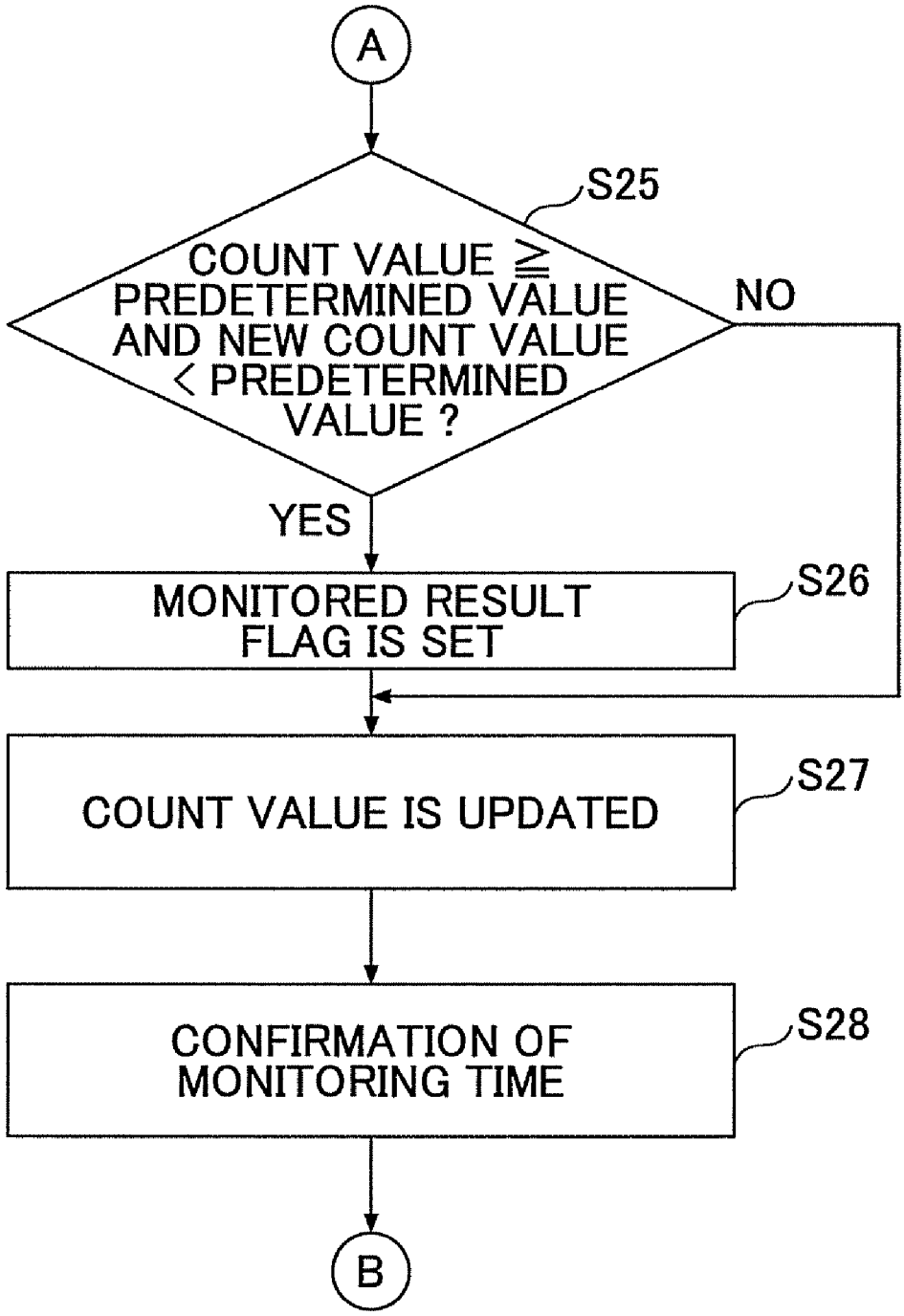
Figure 7:
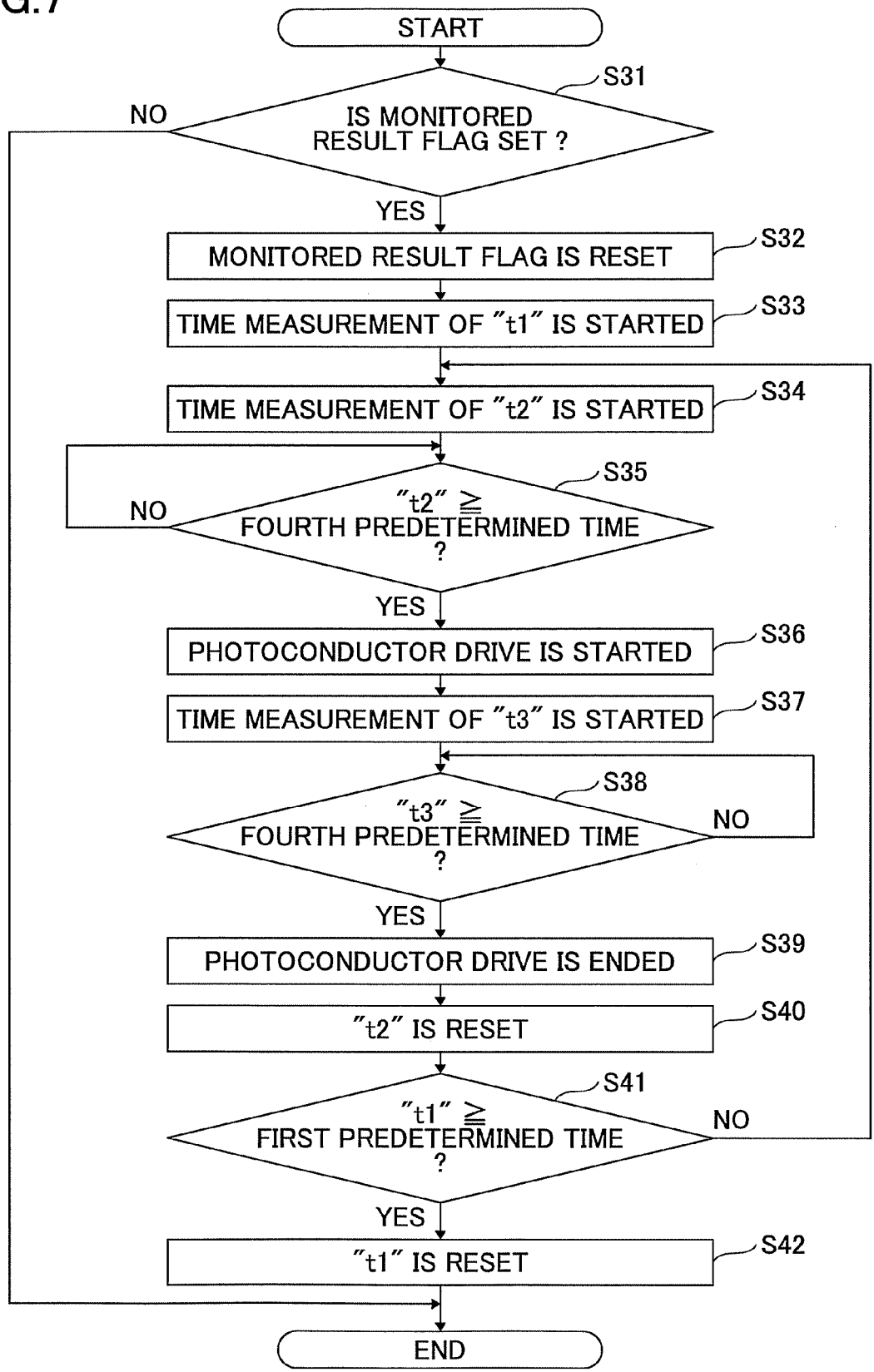
FIG. 7 is a flowchart for explaining an intermittent drive process.
Figure 8:
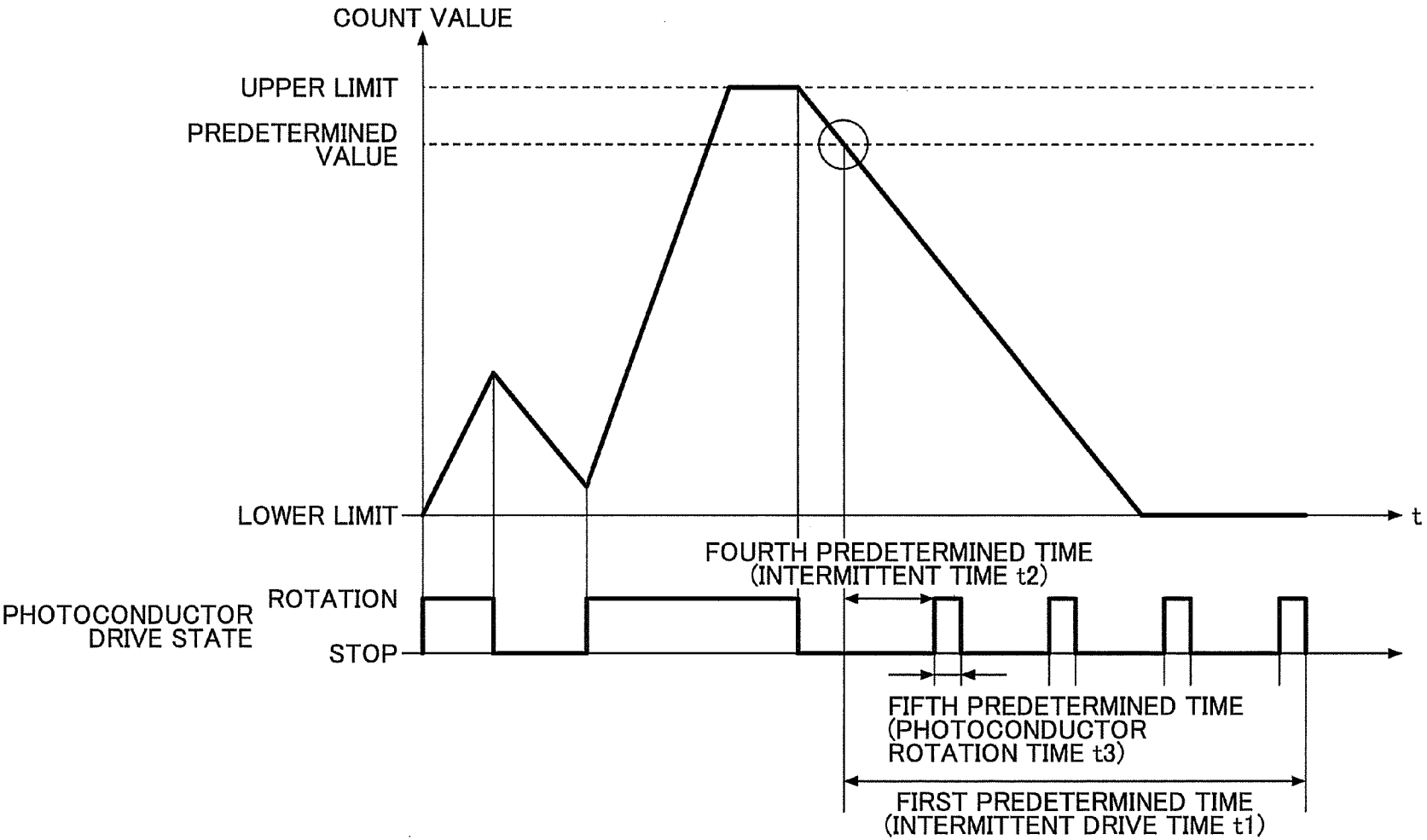
FIG. 8 is a diagram illustrating a transition of a count value during an image formation operation and during an intermittent drive operation.

FIG. 4 is a flowchart for explaining an image formation operation performed by the control unit of the image forming device of the first embodiment. FIG. 5A and FIG. 5B are parts of a flowchart for explaining a photoconductor monitoring process performed by the control unit of the image forming device of the first embodiment. FIG. 7 is a flowchart for explaining an intermittent drive process performed by the control unit of the image forming device of the first embodiment. FIG. 6 is a diagram illustrating the setting of a count-up value with respect to a specific rotational speed of the photoconductor. FIG. 8 is a diagram illustrating a transition of a count value during an image formation operation and during an intermittent drive operation.

As illustrated in FIG. 4, when the power of the image forming device is turned on, a photoconductor monitoring process and an image formation operation process are started and these processes are repeated in an asynchronous manner.

Upon power-up of the image forming device 100, the CPU 10 of the control unit 130 as illustrated in FIG. 3 performs a photoconductor monitoring process (step S1). The photoconductor monitoring process will be described later. Simultaneously with the photoconductor monitoring process, the CPU 10 determines whether the control unit 130 receives a print job (a request of image formation operation) via the I/F 40 (step S2).

When it is determined in step S2 that the print job is received via the I/F 40, the CPU 10 performs a normal image formation operation in accordance with a control program loaded from the ROM 50 to the RAM 60 in response to the print job, which program (image formation operation control unit) is executed by the CPU 10 (step S3).

When it is determined in step S2 that a print job has not been received via the I/F 40, the CPU 10 performs an intermittent drive process which drives an intermittent driving unit, such as a motor, in accordance with a control program loaded from the ROM 50 to the RAM 60, which program (intermittent drive control unit) is executed by the CPU 10 (step S4).

When the image formation operation process or the intermittent drive process is completed, the control is transferred to the step S2 in which the CPU 10 determines again whether the control unit 130 receives a print job via the I/F 40.

Next, the photoconductor monitoring process will be described with reference to FIG. 5A and FIG. 5B.

As illustrated in FIG. 5A, when the power of the image forming device is turned on, the photoconductor monitoring process is started by the CPU 10 of the control unit 130. First, the CPU 10 resets a photoconductor monitoring time to zero (step S11), and sets a count value to a predetermined lower limit (step S12). The CPU 10 starts measurement of the photoconductor monitoring time (step S13), and monitors a rotation state of the photoconductor and detects presence of a rotational condition of the photoconductor drum 109 (step S14). The monitoring of the rotation state of the photoconductor drum 109 may be performed by the CPU 10 by checking the presence of a control signal (rotation command signal) from the CPU 10 to the photoconductor driving device, such as a motor.

When it is determined in step S15 that the photoconductor is in a rotation state, the CPU 10 detects the rotational speed of the photoconductor drum 109 (step S16), and sets a count-up value based on the detected rotational speed of the photoconductor drum 109 (step S17).

A normal method for detecting the rotational speed of the photoconductor which may be used in step S16 is to determine the rotational speed of the photoconductor drum 109 based on the mode (sheet type setting or image quality setting) included in the print job. It is assumed that the image forming device 100 is arranged to vary the rotational speed of the photoconductor drum depending on the print job mode (sheet type setting or image quality setting).

The rotational speed of the photoconductor drum 109 may be considered as being equal to the rotational speed of the intermediate transfer belt 105 because the photoconductor drum 109 and the intermediate transfer belt 105 are in contact with each other. Hence, alternatively, the following steps may be performed instead of the steps S14 to S17. First, a presence of a rotational condition of the intermediate transfer belt 105 is detected. When it is determined that the intermediate transfer belt 105 is in a rotation state, the CPU 10 detects the rotational speed of the intermediate transfer belt 105, and sets a count-up value based on the detected rotational speed of the intermediate transfer belt 105.

The setting of a count-up value corresponding to each of respective rotational speeds of the photoconductor may be defined as illustrated in FIG. 6. The correlation between the count-up value and the rotational speed of the photoconductor in the table form may be stored in the ROM 50 or the RAM 60.

Alternatively, the count-up value may be predetermined as being a fixed value irrespective of the rotational speed of the photoconductor drum. In such a case, the above step S16 may be omitted.

Subsequently, the CPU 10 computes a new count value by adding the count-up value to the count value previously stored in the RAM 60 (step S18). Then, the CPU 10 determines whether the new count value is equal to or smaller than a predetermined upper limit of the count value (step S19).

When it is determined in step S19 that the new count value is larger than the upper limit, the CPU 10 sets the new count value to the upper limit (step S20). In this case, the computed new count value is not used and the upper limit is used. On the other hand, when it is determined in step S19 that the new count value is equal to or smaller than the upper limit, the new count value remains unchanged, and, as illustrated in FIG. 5B, the control is transferred to the following step S25.

When it is determined in step S15 that the photoconductor is not in a rotation state (or in a stop state), the CPU 10 sets a count-down value (step S21), similar to the setting of the count-up value. If the count-down value is predetermined, the predetermined count-down value may be used in the step S21. Alternatively, the setting of a count-down value corresponding to each of the respective rotational speeds of the photoconductor drum may be defined as illustrated in FIG. 6, similar to the setting of the count-up value. The correlation between the count-down value and the rotational speed of the photoconductor drum in the table form may be stored in the ROM 50 or the RAM 60. In this case, although the rotational speed of the photoconductor drum is not detected, a count-down value corresponding to the standard speed of the photoconductor may be read from the table and used in the step S21.

In the image forming device of this embodiment, the count value computed is used as the index that represents an environmental temperature of the photoconductor drum. If a difference in temperature between the photoconductor drum and the outside environment of the image forming device is large, a change rate of the environmental temperature of the photoconductor drum in a standby state is also large. Hence, when the count value computed is large, the count-down value is predetermined as being a large value. In this way, the count value that represents the environmental temperature of the photoconductor drum correctly can be obtained. The environmental temperature of the photoconductor drum depends on the material of the photoconductor drum and the structure of the image forming device, and it is preferred that the count-down value is predetermined to an optimal value in the design stage.

Subsequently, the CPU 10 computes a new count value by subtracting the count-down value from the count value previously stored in the RAM 60 (step S22). The CPU 10 determines whether the computed new count value is equal to or larger than a predetermined lower limit of the count value (step S23).

When it is determined in step S23 that the computed new count value is smaller than the lower limit, the CPU 10 sets the new count value to the lower limit (step S24). In this case, the computed new count value is not used and the lower limit is used. On the other hand, when it is determined in step S23 that the computed new count value is equal to or larger than the lower limit, and the new count value remains unchanged, and the control is transferred to the following step S25.

As illustrated in FIG. 5B, in step S25, the CPU 10 determines whether the count value before the addition of the count-up value in step S18 or the count value before the subtraction of the count-down value in step S22 is above a predetermined value and the new count value is below the predetermined value. When the result of the determination in step S25 is affirmative, the CPU 10 sets a monitored result flag (step S26).

The above step S25 is performed in order to determine whether the count value is in a decreasing state and reaches a predetermined value as in the diagram of FIG. 8. Specifically, when the environmental temperature of the developing device is high and the developing roller is in a stop state, the difference in the toner charging performance between the toner outside the developing device and the toner inside the developing device will be large. If it is determined that the count value is in a decreasing state and reaches the predetermined value, a determination that the intermittent drive process is to be performed is made.

The monitored result flag which is set in step S26 is used in order to make a determination that the intermittent drive process is to be performed in the step S4 in FIG. 4.

If the monitored result flag is already set, the step S26 is neglected and the control is transferred to the following step (step S27). In step S27, the CPU 10 updates the count value to the new count value, with the monitored result flag set, and stores the new count value in the RAM 60.

When the result of the determination in step S25 is negative, the step S26 is skipped and the control is transferred to the step S27, in which the CPU 10 updates the count value to the new count value and stores the new count value in the RAM 60.

Subsequently, the CPU 10 confirms that the photoconductor monitoring time reaches a second predetermined time (which is, for example, 1 second) (step S28). The control is returned back to the step S14 and the subsequent steps are repeated. The count value stored in the RAM 60 will be updated depending on whether the photoconductor drum 109 is in a rotation state or in a stop state. It is preferred that the photoconductor monitoring process is repeated at intervals of a given period (for example, 1 second), as illustrated in FIG. 4. In this embodiment, if the power of the image forming device 100 is turned off, the photoconductor monitoring process is terminated.

Next, the intermittent drive process will be described with reference to FIG. 7.

When it is determined in the step S2 of FIG. 4 that a print job has not been received, the intermittent drive process of FIG. 7 is started as in the step S4 of FIG. 4.

As illustrated in FIG. 7, upon start of the intermittent drive process, the CPU 10 determines whether the monitored result flag as in the photoconductor monitoring process is set (step S31). When the monitored result flag is set, the CPU 10 resets the monitored result flag (step S32).

On the other hand, when the monitored result flag is not set, the intermittent drive process is terminated immediately.

After the monitored result flag is reset in step S32, the CPU 10 starts measurement of an intermittent drive time t1 (step S33), and simultaneously starts measurement of an intermittent time t2 (step S34).

It is assumed that, when the power of the image forming device is turned on, the intermittent drive time t1, the intermittent time t2, and a photoconductor rotation time t3 are reset to zero (0).

The CPU 10 determines whether the intermittent time t2 reaches a fourth predetermined time (S35). When the intermittent time t2 reaches the fourth predetermined time, the CPU 10 starts rotation of the photoconductor drum (step S36), and starts measurement of the photoconductor rotation time t3 (step S37).

The CPU 10 determines whether the photoconductor rotation time t3 reaches a fifth predetermined time (S38). When the photoconductor rotation time t3 reaches the fifth predetermined time, the CPU 10 stops the rotation of the photoconductor drum (step S39), and resets the intermittent time t2 and the photoconductor rotation time t3 to zero (step S40).

The CPU 10 determines whether the intermittent drive time t1 reaches a first predetermined time (S41). When the intermittent drive time t1 does not reach the first predetermined time, the control is returned to the start of the measurement of the intermittent time t2 in the step S34 and the steps S34 to S40 are repeated.

When the intermittent drive time t1 reaches the first predetermined time, the CPU 10 resets the intermittent drive time t1 to zero (step S42). Then, the intermittent drive process is terminated.

If a print job is received during the intermittent drive process and the image formation operation process is to be started, the intermittent drive process is terminated immediately regardless of whether the intermittent drive process is in progress.

FIG. 8 illustrates a transition of the count value during an image formation operation of the image forming device of this embodiment and during an intermittent drive operation thereof. Also, in FIG. 8, the first predetermined time for the intermittent drive time t1, the fourth predetermined time for the intermittent time t2, and the fifth predetermined time for the photoconductor rotation time t3 during the intermittent drive operation are illustrated. In FIG. 8, the horizontal axis denotes the elapsed time from a time the image formation operation of the image forming device is started by a power-up, and the vertical axis denotes the count value. The line graph of the upper portion in FIG. 8 denotes a transition of the count value, and the step-like graph of the lower portion in FIG. 8 denotes a rotation state or a stop state of the photoconductor drum.

The high level of the step-like graph in FIG. 8 indicates the rotation state of the photoconductor drum, and the low level of the step-like graph in FIG. 8 indicates the stop state of the photoconductor drum. The rotation state of the photoconductor drum indicated by the two left-hand parts of the step-like graph in FIG. 8 near the vertical axis indicate the rotation of the photoconductor drum accompanied with an image formation operation. The rotation states of the photoconductor drum indicated by the four right-hand parts of the step-like graph in FIG. 8 indicate the rotation of the photoconductor drum during the intermittent drive operation in which the image formation operation is stopped.

Referring to FIG. 8, the change of the count value will be described. When the image formation operation is enabled, the count value is set to the lower limit and increased in proportion to the photoconductor rotation time accompanied with the image formation operation.

Strictly speaking, the count value is increased gradually. For the sake of convenience, the change of the count value is expressed by a straight line in the diagram of FIG. 8.

When the image formation operation is stopped by stopping the rotation of the photoconductor drum, the count value is decreased at a rate that is the same as the rate of increasing of the count value as in FIG. 8. The rate of decreasing of the count value varies depending on the setting of the count-up value and the count-down value.

When the image formation operation is restarted, the count value is increased to exceed the predetermined value, and reaches the upper limit.

When the image formation operation is continuously performed after the count value reaches the upper limit, the count value is no longer increased and remains at the upper limit.

When the image formation operation is completed and the photoconductor drum is in a standby state, the count value is decreased again to be smaller than the predetermined value.

When the count value is smaller than the predetermined value, the monitored result flag is set. If the photoconductor drum is still in a standby state, the intermittent drive process is performed.

Even if the intermittent drive process is performed, the photoconductor drum is still in a stop state until the intermittent drive time t2 reaches the fourth predetermined time. At this time, the count value is continuously decreased.

When the intermittent drive time t2 reaches the fourth predetermined time, rotation of the photoconductor drum is started. The rotation of the photoconductor drum is continued until the photoconductor rotation time t3 reaches the fifth predetermined time. In this case, if the photoconductor drum is rotated, the count value may be temporarily increased. However, if the photoconductor rotation time t3 is set to a value that is much smaller than the second predetermined time, the count value is continuously decreased without being increased.

When the photoconductor rotation time t3 reaches the fifth predetermined time, the rotation of the photoconductor drum is stopped and the count value is continuously decreased until the intermittent drive time t2 reaches the fourth predetermined time again. In this manner, rotation of the photoconductor drum and stop of the rotation are repeated. When the count value reaches the lower limit, the count value is no longer decreased and held at the lower limit.

When the intermittent drive time t1 reaches the first predetermined time, the intermittent drive process is terminated.

The intermittent driving unit in this embodiment is arranged to perform the intermittent drive process based on a change of the count value. Alternatively, the intermittent driving unit in a modification may be arranged to perform the intermittent drive process based on a change of the ratio of the stopping time to the photoconductor rotation time. In this modification, execution of the intermittent drive process may be started when the ratio of the stopping time to the photoconductor rotation time reaches a predetermined value. In this case, the vertical axis in FIG. 8 indicates the ratio of the stopping time to the photoconductor rotation time, instead of the count value.

Next, an image formation operation performed by a control unit of an image forming device of a second embodiment of the invention will be described with reference to FIG. 9.

This embodiment differs from the first embodiment only in that an environmental temperature and/or an environmental humidity outside the developing device is monitored and the intermittent drive process is performed when a predetermined change in the environmental temperature and/or humidity takes place during a standby state of image formation operation.

The image forming device of this embodiment includes the temperature humidity sensor 131 (detection unit) and the control unit 130 as illustrated in FIG. 2. The control unit 130 (or the CPU 10 in FIG. 3) functions as an environmental memory unit to store the environmental temperature and/or humidity from the sensor 131 in the RAM 60 in FIG. 3. The control unit 130 (or the CPU 10 in FIG. 3) functions as an environmental change determining unit which determines whether a change of the environmental temperature and/or humidity from an end of image formation operation to a time a predetermined time has elapsed from the image formation operation end falls within a predetermined range.

Figure 9:
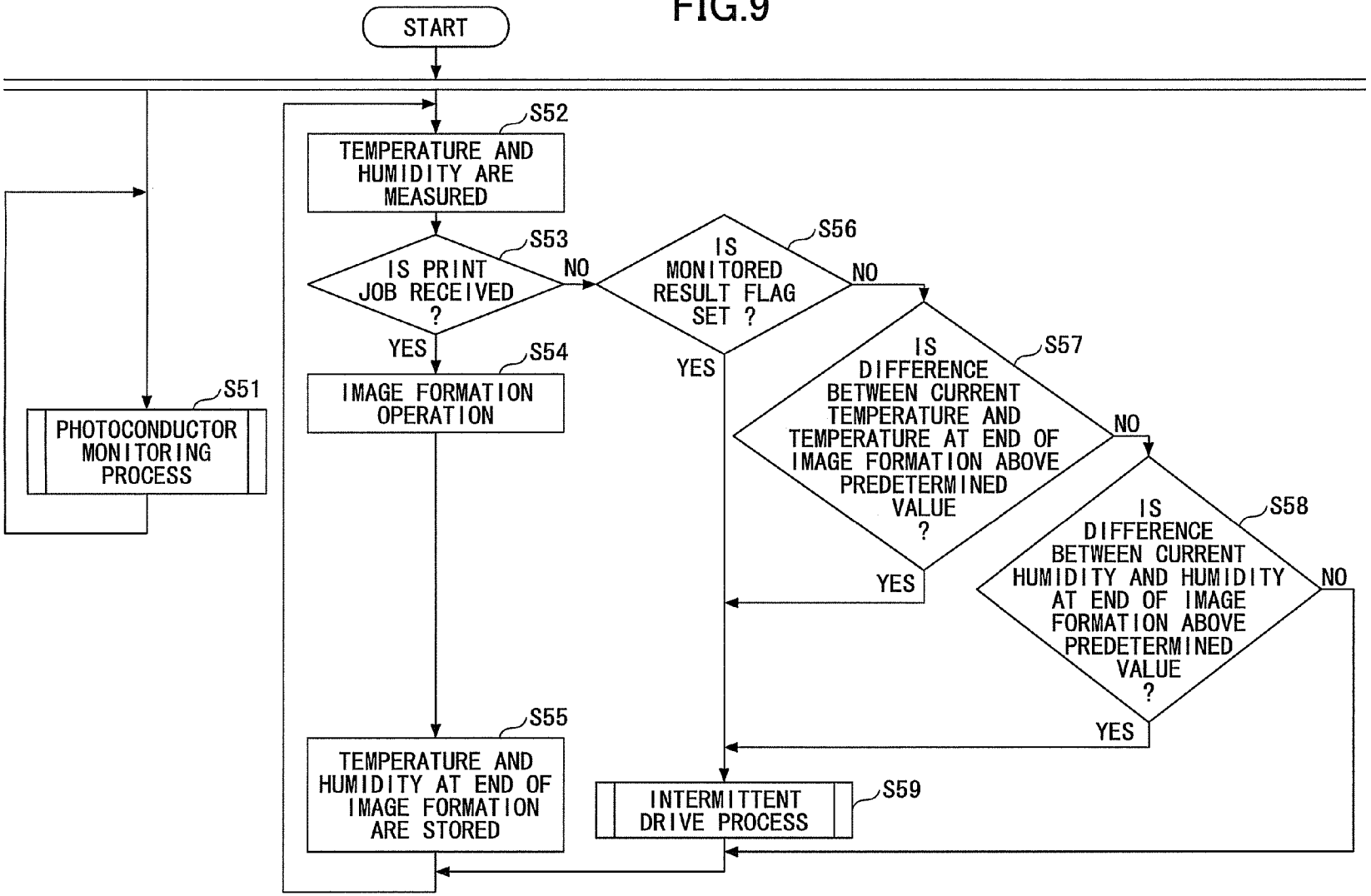
FIG. 9 is a flowchart for explaining an image formation operation performed by a control unit of an image forming device of a second embodiment of the invention.

Referring to FIG. 9, the image formation operation performed by the control unit of the image forming device of the second embodiment will be described. As illustrated in FIG. 9, upon power-up of the image forming device, the CPU 10 of the control unit 130 performs a photoconductor monitoring process (step S51). This photoconductor monitoring process (step S51) is the same as the photoconductor monitoring process (step S1) of the first embodiment, and a description thereof is omitted.

Upon the power-up of the image forming device, the CPU 10 measures an environmental temperature and an environmental humidity during a standby state of image formation operation, by using the temperature humidity sensor 131 disposed outside the developing device (step S52).

A print job reception check process (step S53) of this embodiment is the same as the print job reception check process (step S2) of the first embodiment, and a description thereof is omitted.

When it is determined in step S53 that the print job is received via the I/F 40, the CPU 10 performs the image formation operation (step S54). The CPU 10 stores the environmental temperature and/or environmental humidity measured with the temperature humidity sensor 131 at the end of the image formation operation in the RAM 60 (step S55). Then, the control is returned back to the step S52 again.

When it is determined in step S53 that a print job has not been received via the I/F 40, the CPU 10 determines whether the monitored result flag is set in the photoconductor monitoring process in the step S51 (step S56). When it is determined in step S56 that the monitoring flag is set, the CPU 10 performs the intermittent drive process (step S59).

The intermittent drive process (step S59) of this embodiment is essentially the same as the intermittent drive process (step S4) of the first embodiment as illustrated in FIG. 7. The intermittent drive process of the step S59 only differs from the intermittent drive process illustrated in FIG. 7 in that the step S31 in FIG. 7 is omitted because the setting of the monitored result flag is already checked in the step S56.

After the intermittent drive process (step S59) is completed, the control is returned back to the step S52.

When it is determined in step S56 that the monitoring flag is not set, the CPU 10 determines whether a difference between the environmental temperature in the vicinity of the photoconductor drum previously stored at the end of the image formation operation in the step S55 and the environmental temperature in the vicinity of the photoconductor drum currently measured in the step S52 exceeds a predetermined value (step S57).

When it is determined in step S57 that the difference exceeds the predetermined value, the CPU 10 performs the intermittent drive process (step S59).

When it is determined in step S57 that the difference does not exceed the predetermined value, the CPU 10 determines whether a difference between the environmental humidity in the vicinity of the photoconductor drum previously stored at the end of the image formation operation in the step S55 and the environmental humidity in the vicinity of the photoconductor drum currently measured in the step S52 exceeds a predetermined value (step S58).

When it is determined in step S58 that the difference exceeds the predetermined value, the CPU 10 performs the intermittent drive process in the step S59.

When it is determined in step S58 that the difference does not exceed the predetermined value, the CPU 10 does not perform the intermittent drive process in the step S59. Then, the control is returned back to the step 52.

In this embodiment, when at least one of a change of the environmental temperature and a change of the environmental humidity exceeds the predetermined value, the intermittent drive operation of the photoconductor drum is performed. Alternatively, the intermittent drive operation may be performed when each of the changes of the environmental temperature and environmental humidity exceeds the predetermined value. Such a modification may be used according to the use condition of the image forming device or the charging performance of the toner.

In this embodiment, not only the count value and the monitored result flag set in the photoconductor monitoring process, but also a change of the environmental temperature and/or environmental humidity in the vicinity of the photoconductor drum is monitored, and the intermittent drive operation of the photoconductor drum is performed appropriately. Hence, it is possible to provide an image forming device which is able to prevent the image density irregularities due to changes of the temperature and/or humidity of the toner resulting from the changes of the environmental temperature and/or humidity in the vicinity of the photoconductor drum. If the second embodiment is combined with the first embodiment, it is possible to provide an image forming device which is able to reliably withstand the environmental change in the vicinity of the photoconductor drum.

Figure 10:
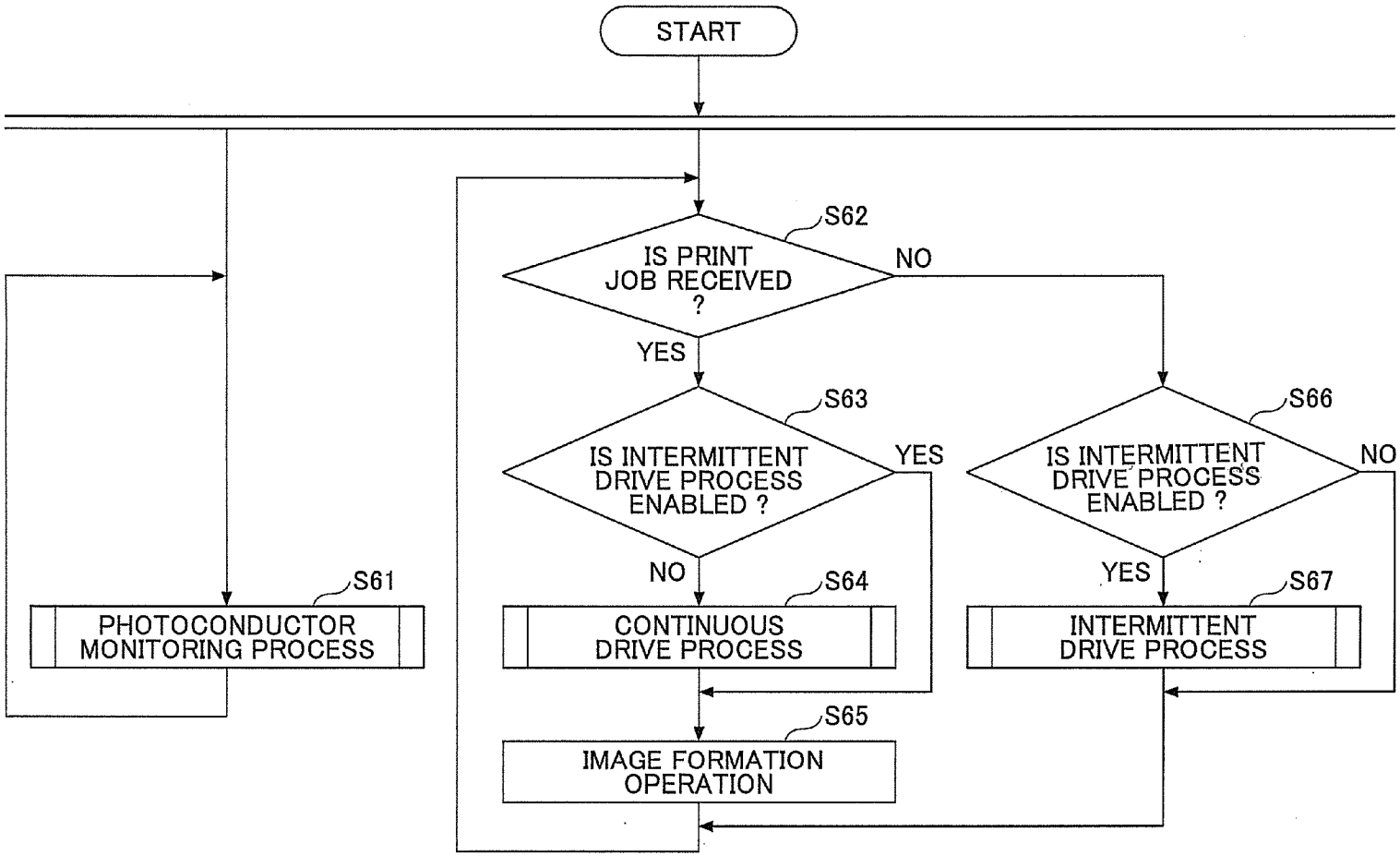
FIG. 10 is a flowchart for explaining an image formation operation performed by a control unit of an image forming device of a third embodiment of the invention.
Figure 11:
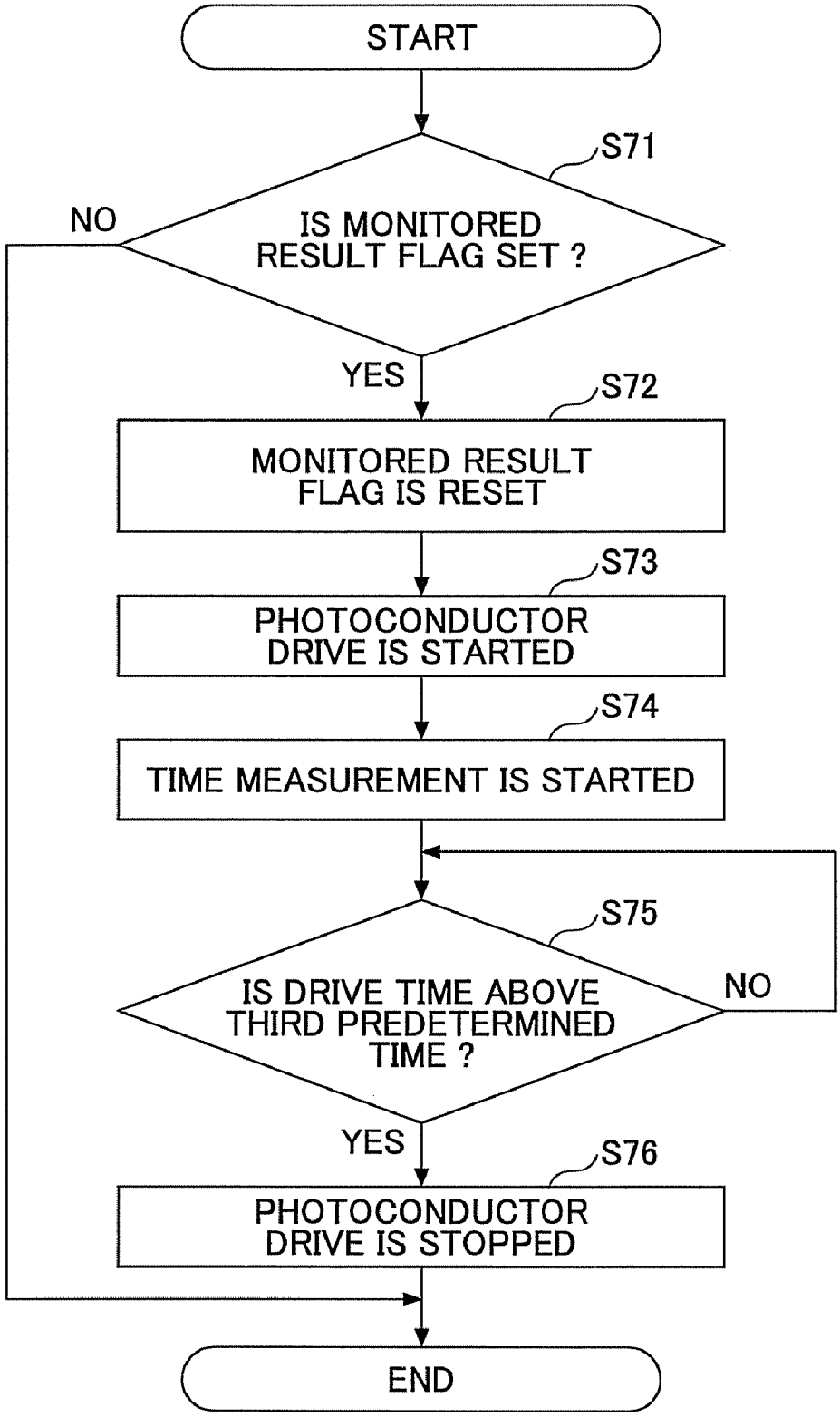
FIG. 11 is a flowchart for explaining a continuous drive process.

Next, an image formation operation performed by a control unit of an image forming device of a third embodiment of the invention will be described with reference to FIGS. 10 and 11.

This embodiment differs from the first embodiment only in that, in addition to the component parts the image forming device of the first embodiment, the image forming device further includes a continuous driving unit which performs continuous rotation of the photoconductor drum (continuous drive operation) before an image formation operation is started, and a selecting unit which selectively actuates one of the intermittent drive operation and the continuous drive operation. The image forming device of this embodiment can perform selectively one of the intermittent drive operation and the continuous drive operation in accordance with a command input from a user.

The image formation operation of this embodiment will be described with reference to FIG. 10. As illustrated in FIG. 10, upon power-up of the image forming device, the CPU 10 of the control unit 130 as illustrated in FIG. 3 performs a photoconductor monitoring process (step S61). This photoconductor monitoring process (step S61) is the same as the photoconductor monitoring process (step S1) of the first embodiment, and a description thereof is omitted.

A print job reception check process (step S62) of this embodiment is the same as the print job reception check process (step S2) of the first embodiment, and a description thereof is omitted.

When it is determined in step S62 that the print job is received via the I/F 40, the CPU 10 determines whether a user sets a command that enables the intermittent drive process of the image forming device according to the received print job (step S63). When the result at the determination in step S62 is negative, the control is transferred to step S66 which will be described later.

When it is determined in step S63 that the user does not set a command which enables the intermittent drive process of the image forming device according to the received print job, the CPU 10 causes the image forming device to perform the continuous drive process (step S64). The continuous drive process will be described later.

When it is determined in step S63 that the user sets the command which enables the intermittent drive process of the image forming device according to the received print job, the CPU 10 skips the continuous drive process in step S64 and causes the image forming device to perform the image formation operation (step S65). This image formation operation is the same as that of the first embodiment 1, and a description thereof is omitted.

Accordingly, the user is allowed to selectively actuate one of the intermittent drive process and the continuous drive process. This means that when the user enables the intermittent drive process, the continuous drive process is disabled.

In this embodiment, selection of one of the intermittent drive process and the continuous drive process is performed by the user. Alternatively, the selection may be performed based on a continuation time of a standby state of image formation operation in accordance with a program executed by the CPU 10.

When the image formation operation in step S65 is completed, the control is returned back to the step S62. When the result at the determination in step S62 is negative (no print job is received), the CPU 10 determines whether the user sets a command that enables the intermittent drive process of the image forming device (step S66).

When it is determined in step S66 that the user sets the command that enables the intermittent drive process, the CPU 10 causes the image forming device to perform the intermittent drive process (step S67). After an end of the intermittent drive process, the control is returned back to the step S62.

When it is determined in step S66 that the user has not set a command that enables the intermittent drive process, the CPU 10 skips the intermittent drive process in step S67, and the control is returned back to the step S62.

The intermittent drive process (step 367) in this embodiment is the same as the intermittent drive process (step S4 in FIG. 4) in the first embodiment, and a description thereof is omitted.

The continuous drive process of this embodiment will be described with reference to FIG. 11. As illustrated in FIG. 11, upon start of the continuous drive process, the CPU 10 determines whether the monitored result flag is set (step S71).

When it is determined in step S71 that the monitored result flag is set, the continuous drive process resets the monitored result flag (step S72), and starts continuous rotation of the photoconductor drum (step S73). Simultaneously, the CPU 10 starts measurement of a photoconductor drive time (step S74).

The CPU 10 determines whether the measured photoconductor drive time exceeds a third predetermined time (step S75). When the photoconductor drive time exceeds the third predetermined time, the CPU 10 stops the continuous rotation of the photoconductor drum (step S76). Then, the continuous drive process is terminated.

When it is determined in step S71 that the monitored result flag is not set, the continuous drive process is terminated immediately.

As a modification of the third embodiment, the process which enables the intermittent drive process to be performed according to a change of the environmental temperature or environmental humidity, as illustrated in the second embodiment, may be performed additionally.

In the third embodiment, when a standby state of the image forming device continues over an extended period of time, performing continuous rotation of the photoconductor drum before a start of a next image formation operation is more effective to make the toner state uniform than performing the intermittent drive operation at an end of the current image formation operation. If the third embodiment is combined with the second embodiment, it is possible to effectively make the toner state uniform.

In the above-described embodiments, the image forming device of intermediate transfer type using the intermediate transfer belt 105 has been embodied and explained. However, the present invention may be applied also to an image forming device of direct transfer type using a transport belt which is provided to transport a copy sheet. In the image forming device of the latter type, the transport belt functions as a sheet transport unit, instead of the intermediate transfer belt 105 as in the image forming device of the former type.

As described in the foregoing, according to the image forming device of at least one of the above-described embodiments, it is possible to prevent, without using an output signal of a sensor disposed in a vicinity of the photoconductor drum, the image density irregularities which easily take place at a start of an image formation operation.

The present invention is not limited to the specifically disclosed embodiments, and changes and modifications may be made without departing from the scope of the present invention.

The present application is based on Japanese patent application No. 2009-065297, filed on Mar. 17, 2009, and Japanese patent application No. 2010-050385, filed on Mar. 8, 2010, the contents of which are incorporated herein by reference in their entirety.

What is claimed is:

1. An image forming device, comprising:

an image support object;

a charging unit that electrically charges a surface of the image support object which is rotated;

an exposure unit that exposes the charged surface of the image support object to a light beam so that an electrostatic latent image is formed on the image support object surface;

a developing unit that causes an electrically charged toner to adhere to the electrostatic latent image on the image support object surface so that a toner image is formed on the image support object surface;

a monitoring unit configured to sequentially update a count value to a new count value according to a rotation state and a stop state of the image support object; and an intermittent driving unit configured to intermittently rotate the image support object according to the new count value generated by the monitoring unit after an image formation operation to form the toner image on the image support object surface is completed.

2. The image forming device according to claim 1, wherein the monitoring unit is configured to detect a rotation state or a stop state of the image support object for each of intervals of a predetermined time, and to update the count value so that, if the image support object is in the rotation state, a count-up value is added to the count value to generate the new count value, and if the image support object is in the stop state, a count-down value is subtracted from the count value to generate the new count value, and the intermittent driving unit is configured to perform the intermittent rotation of the image support object when the count value at an end of the image formation operation is above a predetermined value and the new count value is less than the predetermined value.

3. The image forming device according to claim 1, further comprising:

a detection unit configured to detect a temperature or a humidity outside the developing unit; and an environmental change determining unit configured to determine whether a difference is above a second predetermined value, the difference being between a detection result of the detection unit at an end of the image formation operation and a detection result of the detection unit at a time the count value changes to the new count value, wherein the count value is above a first predetermined value at the end of the image formation operation, and wherein the new count value is less than the first predetermined value, wherein the intermittent driving unit is actuated when the environmental change determining unit determines that the difference is above the second predetermined value.

4. The image forming device according to claim 2, wherein, when the new count value exceeds a predetermined upper limit, the monitoring unit changes the new count value to the predetermined upper limit.

5. The image forming device according to claim 2, wherein, when the new count value is less than a predetermined lower limit, the monitoring unit changes the new count value to the predetermined lower limit.

6. The image forming device according to claim 2, wherein the count-up value is changed to a value according to a rotational speed of the image support object.

7. The image forming device according to claim 2, wherein, when a change from the count value above the predetermined value to the new count value less than the predetermined value occurs during operation of the intermittent driving unit, the intermittent driving unit performs the intermittent rotation of the image support object for a predetermined time restarting from a time the change occurs.

8. The image forming device according to claim 1, wherein the monitoring unit is configured to detect a ratio of a stopping time of the image support object to an image-formation-operation time, and the intermittent driving unit is configured to perform, when the ratio detected by the monitoring unit exceeds a predetermined value, the intermittent rotation of the image support object for a predetermined time.

9. The image forming device according to claim 1, further comprising:

a continuous driving unit that performs continuous rotation of the image support object for a predetermined time when an image formation operation to form a toner image on the image support object surface is started; and a selecting unit that selectively actuates one of the intermittent driving unit and the continuous driving unit.

10. A non-transitory computer-readable recording medium storing a program which, when executed by a computer of an image forming device, causes the computer to perform an image forming method, the image forming device including an image support object, a charging unit electrically charging a surface of the image support object which is rotated, an exposure unit exposing the charged surface of the image support object to a light beam so that an electrostatic latent image is formed thereon, and a developing unit causing an electrically charged toner to adhere to the electrostatic latent image on the image support object surface so that a toner image is formed thereon, the image forming method comprising:

updating a count value to a new count value sequentially according to a rotation state and a stop state of the image support object; and intermittently rotating the image support object according to the new count value generated by the updating after an image formation operation to form the toner image on the image support object surface is completed.

11. The non-transitory computer-readable recording medium according to claim 10, wherein the updating detects a rotation state or a stop state of the image support object for each of intervals of a predetermined time, and updates the count value so that, if the image support object is in the rotation state, a count-up value is added to the count value to generate the new count value, and if the image support object is in the stop state, a count-down value is subtracted from the count value to generate the new count value, and the intermittently rotating performs the intermittent rotation of the image support object when the count value at an end of the image formation operation is above a predetermined value and the new count value is less than the predetermined value.

12. The non-transitory computer-readable recording medium according to claim 10, wherein the image forming method further comprises:

detecting a temperature or a humidity outside the image forming device; and determining whether a difference is above a second predetermined value, the difference being between a detection result of the detection unit at an end of the image formation operation and a detection result of the detection unit at a time the count value changes to the new count value, wherein the count value is above a first predetermined value at the end of the image formation operation, and wherein the new count value is less than the first predetermined value, wherein the intermittent rotation of the image support object is actuated when the determining determines that the difference is above the second predetermined value.

13. The non-transitory computer-readable recording medium according to claim 11, wherein, when the new count value exceeds a predetermined upper limit, the updating changes the new count value to the predetermined upper limit.

14. The non-transitory computer-readable recording medium according to claim 11, wherein, when the new count value is less than a predetermined lower limit, the updating changes the new count value to the predetermined lower limit.

15. The non-transitory computer-readable recording medium according to claim 11, wherein the count-up value is changed to a value according to a rotational speed of the image support object.

16. The non-transitory computer-readable recording medium according to claim 11, wherein, when a change from the count value above the predetermined value to the new count value less than the predetermined value occurs during operation of the intermittent rotation of the image support object, the intermittently rotating performs the intermittent rotation of the image support object for a predetermined time restarting from a time the change occurs.

17. The non-transitory computer-readable recording medium according to claim 10, wherein the updating detects a ratio of a stopping time of the image support object to an image-formation-operation time, and the intermittently rotating performs, when the ratio detected by the updating exceeds a predetermined value, the intermittent rotation of the image support object for a predetermined time.

18. The non-transitory computer-readable recording medium according to claim 10, wherein the image forming method further comprises:

performing continuous rotation of the image support object for a predetermined time when an image formation operation to form a toner image on the image support object surface is started; and selectively actuating one of the intermittently rotating and the continuous rotation.

* * * * *